US011944190B2

(12) United States Patent
Bentivengo

(10) Patent No.: US 11,944,190 B2
(45) Date of Patent: Apr. 2, 2024

(54) POST ENGAGEABLE TABLE

(71) Applicant: Luis Bentivengo, Temecula, CA (US)

(72) Inventor: Luis Bentivengo, Temecula, CA (US)

( * ) Notice: Subject to any disclaimer, the term of this patent is extended or adjusted under 35 U.S.C. 154(b) by 0 days.

(21) Appl. No.: 17/864,257

(22) Filed: Jul. 13, 2022

(65) Prior Publication Data

US 2023/0015230 A1 Jan. 19, 2023

Related U.S. Application Data

(60) Provisional application No. 63/221,137, filed on Jul. 13, 2021.

(51) Int. Cl.
*A47B 13/02* (2006.01)

(52) U.S. Cl.
CPC ..... *A47B 13/023* (2013.01); *A47B 13/021* (2013.01)

(58) Field of Classification Search
CPC ..... A47B 13/021; A47B 5/00; A47B 5/02
See application file for complete search history.

(56) References Cited

U.S. PATENT DOCUMENTS

| | | | | |
|---|---|---|---|---|
| 7,155,860 | B1 * | 1/2007 | Ferguson, III | A01G 9/02 248/219.4 |
| 8,397,648 | B1 * | 3/2013 | Palladino | A47B 37/04 108/42 |
| 9,445,664 | B1 * | 9/2016 | Gapp | A47B 13/16 |
| 10,123,598 | B2 * | 11/2018 | Achillopoulos | A45C 5/14 |
| 10,768,073 | B2 * | 9/2020 | Maschmeyer | G01M 15/042 |
| 2009/0120477 | A1 * | 5/2009 | Li | A45B 3/04 135/16 |
| 2014/0130719 | A1 * | 5/2014 | Raml | A47B 5/02 108/42 |
| 2015/0122157 | A1 * | 5/2015 | Cote | A01K 39/01 108/42 |
| 2016/0120301 | A1 * | 5/2016 | Cross | A47B 13/003 108/42 |
| 2016/0353877 | A1 * | 12/2016 | Brus | A47G 7/044 |
| 2018/0249838 | A1 * | 9/2018 | Melaragno | A47B 5/04 |
| 2020/0315341 | A1 * | 10/2020 | Brennan | A47B 37/04 |
| 2021/0345627 | A1 * | 11/2021 | Gonzalez | A22C 25/18 |
| 2023/0106905 | A1 * | 4/2023 | Christensen | B25H 3/06 108/152 |

* cited by examiner

*Primary Examiner* — Daniel J Rohrhoff
(74) *Attorney, Agent, or Firm* — Dann K. Harms

(57) ABSTRACT

A post engageable table system is provided where one or two half sections of a table are removably engageable to one or both sides of an upright support post. Compressive fasteners adjacent recesses on a contact edge of each table half section are positionable to a compressive engagement with a second side of the post wherein they can be engaged, removed, or adjusted for height in such an engagement.

4 Claims, 5 Drawing Sheets

POST ENGAGEABLE TABLE

This application claims priority to U.S. Provisional Patent Application Ser. No. 63/221,137 filed on Jul. 13, 2021 which is incorporated herein in its entirety by this reference thereto.

BACKGROUND OF THE INVENTION

1. Field of the Invention

The present invention relates generally to tables. More particularly, it relates to a table configured for engagement to a post such as an H-shaped post in a height-adjustable removable engagement thereto, thereby allowing it to be adjusted for height when needed.

2. Prior Art

Outdoor patios are widely enjoyed throughout the United States and many other countries. Such outdoor patios frequently have shaded areas which are positioned to provide users, enjoying their time outside, with an area shaded from direct sunlight.

Many such outdoor structures, which are constructed to provide such shade and rain coverage to patio occupants, are formed from wood. However, many outdoor shade and weather protecting structures positioned on patios are modular in construction and formed from metal structural components.

In either case, such structures conventionally employ vertical support posts which provide support for overhead positioned shade components forming the roof. The exterior configuration of such post can vary.

The forgoing examples of related art in the field of patio shade structures and any limitation related therewith are intended to be illustrative and not exclusive, and they do not imply any limitations on the tweezer invention described and claimed herein. Various limitations of the related art will become apparent to those skilled in the art upon a reading and understanding of the specification below and the accompanying drawings.

SUMMARY OF THE INVENTION

The table device and system herein disclosed and described provides a table which is easily engaged and operatively positioned upon patio shade structures and similar patio enclosures which include vertical posts. The table device is configured for easy engagement to upright support posts conventionally used for such structures. In addition to easy engagement, the table device herein is configured for easy disengagement and for easy height positioning on the chosen post. Such can be accomplished by professional builders as well as property owners having such an outdoor structure supported by upright posts for their home or business.

The device has a configuration developed in experimentation which allows for an easy removable engagement to the vertically disposed posts or supports which hold the roof elevated above the patio or other area thereunder. In one mode, the table device can be engaged to such upright posts to form a complete round table which surrounds the post to which is mounted. In another mode herein, a half-round table can be engaged to one side of the upright post, should such be desirable.

The table device, when employed for a half-round table, is adapted for connection to the upright post through the provision of a first recess which is shaped with an edge which mirrors the exterior surface of the post to which it engages. Each table has, on one edge, a pair of recesses formed therein which are sized to engage around a single linear post or an H-shaped post as the case may be. Where employed with a single upright, such as a 4×4 or 4×6 upright, it may be placed in one of the two recesses. Thereafter, at least one compressive fastener operatively engaged with the table, may be compressed against the upright positioned in one of the two recesses. By compressive fastener is meant a fastener which is attached to each half section, which can be adjusted by a user to impart an increasing compressive contact during such adjustment with a post and thereby form a removable engagement thereto, held by the compressive contact. Such compressive fasteners are also easily released by the user, operating such, to disengage the compressive contact.

In a particularly preferred configuration of the device herein, each half-round portion of the table to be engaged with a post is configured with a pair of recess formed to an H-shape. By H-shape is meant that a first elongated upright side section is engaged to a second elongated upright side section by a connective crossing section of the post in a manner which forms an H-shape cross section to the post.

The table device herein is configured with two recesses running parallel to each other which are sized to slide upon a first side of a support post having an H-shaped cross section. Once so positioned, the half-round body portion can be affixed to the H-shaped post at a chosen height above the ground or support surface using at least one and preferably two compressible fasteners. The compressive fasteners are operatively positioned on a bottom surface of each half portion of the table. This allows the user to adjust the compressive fasteners to achieve a removable compressive engagement to a post. A single half section of table can be mounted if a table on one side of the post is all that is needed. While depicted as a substantially round or oval table herein, the table can also be rectangular shaped and one or two such rectangular table halves can be engaged to an H-shaped or rectangular post in the same fashion.

Where a round or in some cases a rectangular table is desirable, which surrounds the supporting post with a table surface, the device herein employs a first half portion of the formed table and a second half portion of the formed table to form a tabletop which surrounds the post upon which it is engaged.

In this mode, each half portion of the table is removably engageable with one side of the chosen post using the compressible fasteners engaged thereto. At a rear or mating edge of each half portion of the table, the two half portions will preferably form a contact with each other once both are operatively engaged to the post using the compressible fasteners. This eliminates any gaps where items might fall through when positioned on the formed table top.

Because no tools are required and because the formed recess or recesses in each half portion of the table device is shaped to conform to the exterior surface of the post to which it engages, mounting is easy for property owners and professional builders alike, either during patio shade construction or afterwards. Further, should a different height from the support surface for the post and users walking on such be desired, the table may be easily raised or lowered by simply loosening the compressive engagement and re tightening it at the desired height.

With respect to the above description, before explaining at least one preferred embodiment of the herein disclosed post engageable table invention in detail, it is to be understood that the invention is not limited in its application to the details of construction and to the arrangement of the components in the following description or illustrated in the drawings. The post engageable table invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other post engageable structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Finally, the term "substantially" if not otherwise defined, means plus or minus ten percent.

It is an object of this invention to provide a removably engageable table which is easily connected to an upright post during or after construction.

It is a further object of this invention to provide such a post engageable table device which allows for easy mounting, dismounting, and height adjustments, through the provision of compressive fasteners hidden on the underside of the formed table.

Another object of this invention is the provision of a table which can be engaged to upright posts to yield a single tabletop on one side of the post, or a table top which entirely surrounds the post supporting it.

Other objects, features, and advantages of the present post engageable table invention, as well as the advantages thereof over existing prior art, will become apparent from the description to follow, and are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features of the disclosed post engageable table device. It is intended that the embodiments and figures disclosed herein are to be considered illustrative rather than limiting.

Figure 1:
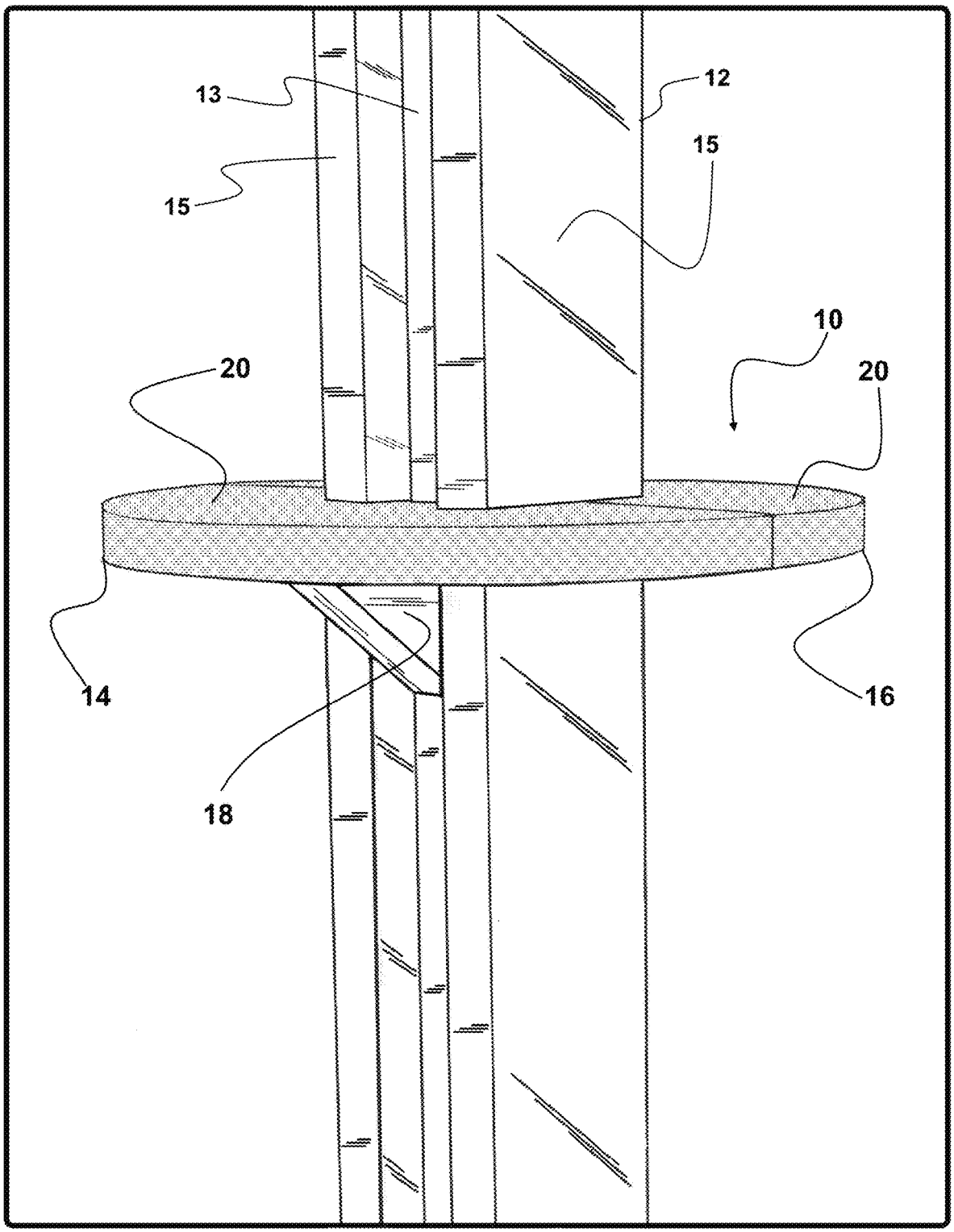
FIG. 1 shows a perspective view of the post engageable table device herein operatively engaged upon an upright support post with the recesses formed in each half section conforming to the exterior shape of one side of the post.

Other aspects of the presently disclosed post engageable table invention shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the post engageable table device as it is oriented and appears in the drawings and are used for convenience only, and they are not intended to be limiting or to imply that the device has to be used or positioned in any particular orientation.

Now referring to drawings in FIGS. 1-9, wherein similar components are identified by like reference numerals, there is seen in FIG. 1 a perspective view of the post-engageable table device 10 herein. As shown, the device 10 is in an as-used or mounted positioning upon a support post 12, such as a conventional 4×4 inch or 4×6 inch post or upon an H-shaped support post 12 which are employed to support a roof structure. Also shown is a vertical support 18, which extends from the bottom of both the first half section 14 and second half section 16, when used, to provide diagonal support to help prevent downward movement when items or objects with weight are positioned on the top surface 20 of either half portion of the formed table device 10.

Figure 7:
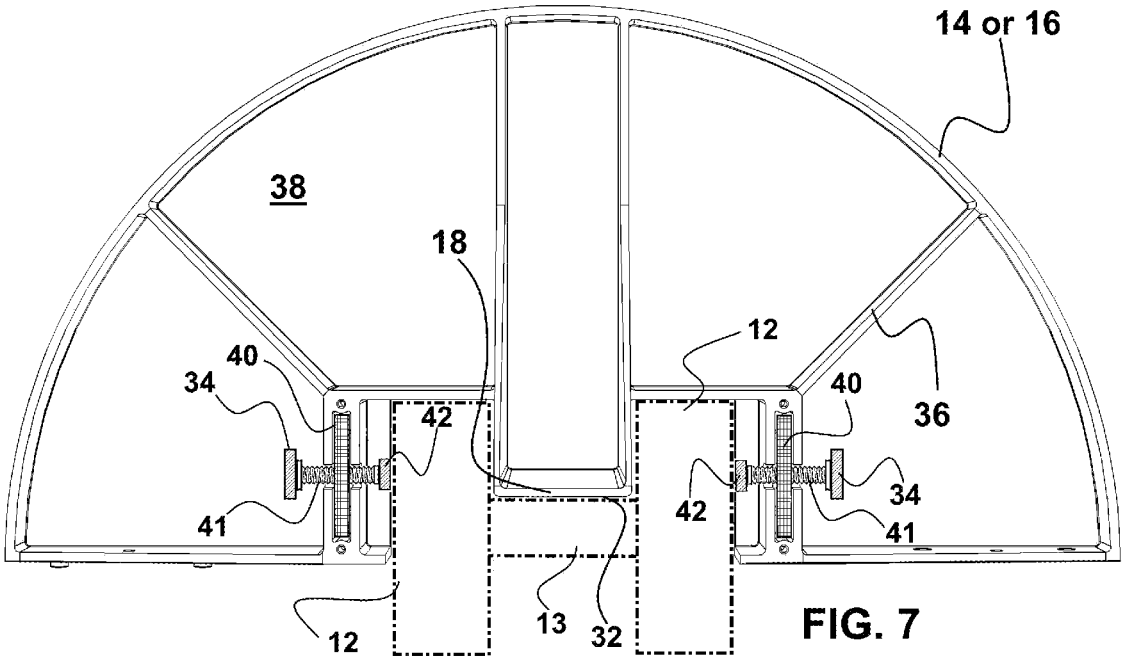
FIG. 7 shows a bottom view of a half section of the table device herein showing support ribs thereon which are configured for positioning of compressive fasteners therein.
Figure 9:
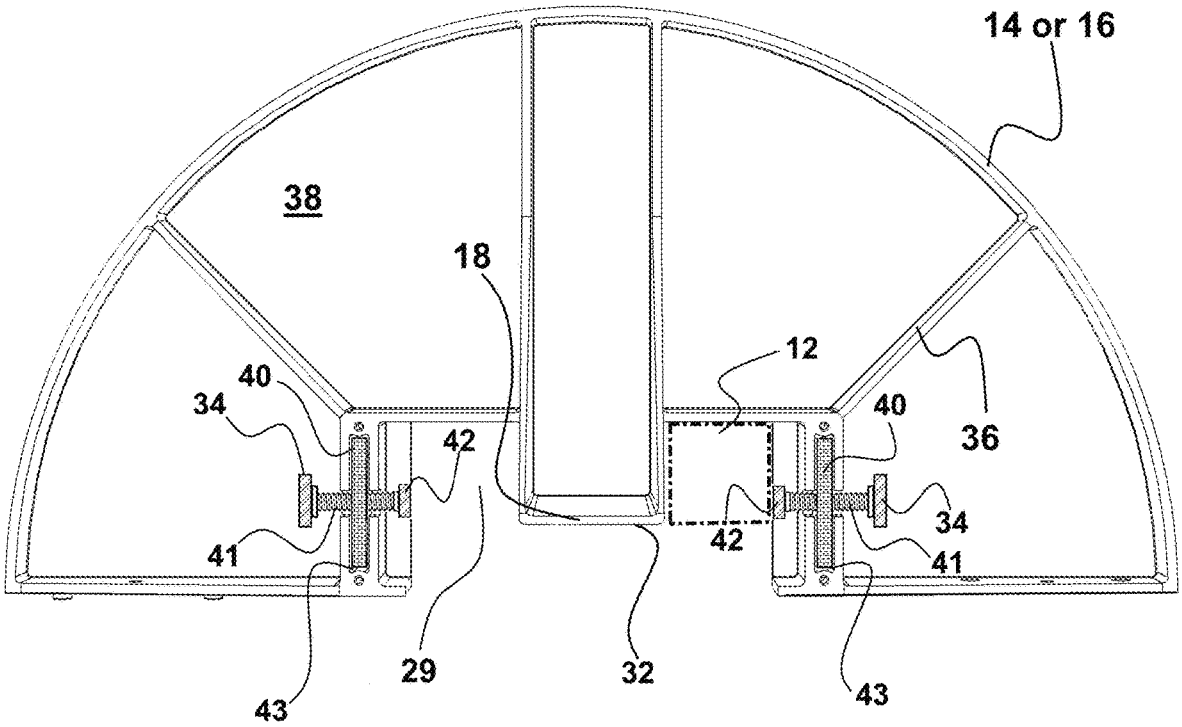
FIG. 9 depicts a bottom view of a half section of the table device herein, as in FIG. 8, showing the removable adjustable engagement to a support post such as a 4 inch by 4 inch or 4 inch by 6 inch post or similar metal or wood support post.

This vertical support 18 also provides a post contact surface 32 which is positioned to be compressed against the facing surface of a chosen post 12 when the compressive fasteners 34, such as in FIG. 7, are used to compressibly hold the half section 14 of the table to an H-shaped post or to a rectangular post, as in FIG. 9, for example.

The vertical support 18 is positioned in between a centrally located first recess 28 and second recess 29 and has side surfaces 31 positioned for compressive contact against any support post 12 located in either or both of the first recess 28 or second recess 29 when the compressive fastener 34 is tightened. Thus, this vertical support 18 is especially preferred in all modes of the device 10 herein to provide such weight support to prevent rotation of the half section 14 or 16 and to provide for the compressive removable and adjustable engagement upon the chosen post 12.

As can be seen in FIG. 1, a first half section 14 can be positioned on a first side of the post 12, and a second half section 16, forming a surrounding table device 10, may be positioned on the opposite side of the post 12. Both half sections are held in position by a compressive engagement of compressive fasteners 34 (FIG. 7) which are attached to each which compress a portion of the post 12 in between the compressive fastener 34 and one of the side surfaces 31 of the vertical support 32.

As shown, in a particularly preferred mode of the device 10, the post 12 can have a cross-sectional "H-shape" (FIG. 7) in that two elongated rectangular side sections 15 of the post are connected by a crossing section 13 of the post. Such H-shaped posts are conventionally used for roof supports. A recess is formed in between both side sections 15 and one side of the cross section 13 on each side of the post 12. Thus, by H-shaped herein is meant that the post may have an H-shape in a cross sectional view with each side of the post forming one half of that shape.

When formed to surround the chosen post having the H-shape cross section, a first half section 14 and a second half portion 16 are, as noted herein, configured with recesses which have a recess shape that mirrors one exterior side of the H-shape of the post 12 on each side thereof. This allows both of the half sections to slide upon one side of the H-shaped post 12 and form a flush mount therewith. Mating planar side edges 22 of each half section contact each other which leaves no gaps between the half sections and the post surface. Of course a single half section 14 may be removably mounted without the secondary half section where only a half round or half rectangular table is desired.

Where the device is engaged on a rectangular shaped post 12, such as in FIG. 9, only a single half section is engageable using the compressive fasteners 34, so while the H-shaped post will provide for engagement of one or two half sections in an adjustable removable engagement, where the half section is engaged to a rectangular post, such as in FIG. 9, only a single half section is removably attachable. However, the device 10 can engage either type of post.

Figure 2:
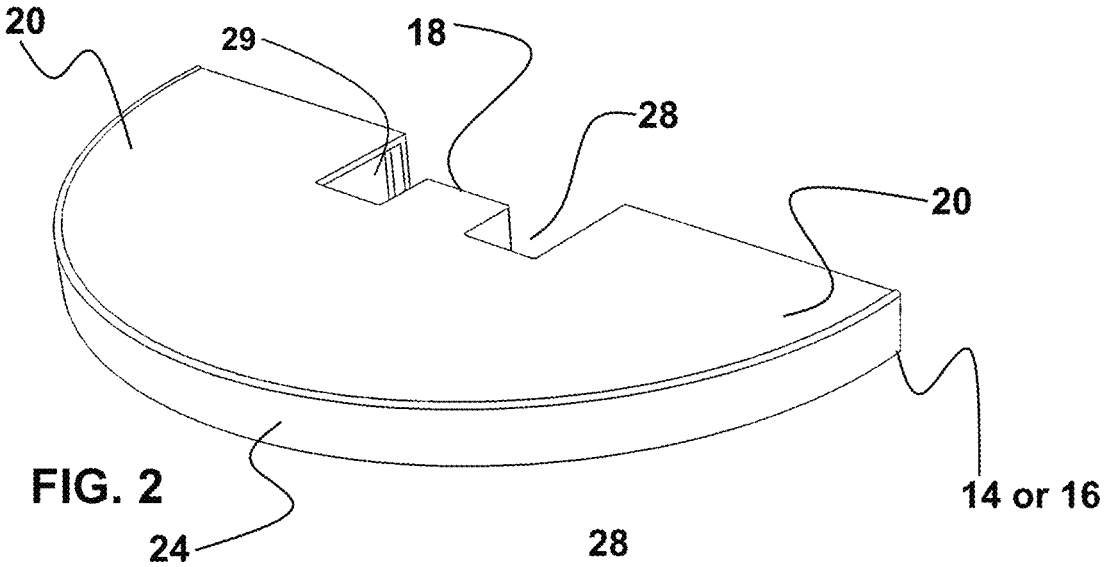
FIG. 2 shows a perspective view of a table half section showing the planar side edge having an H-shaped recess formed therein and showing the table top and opposite side edge.
Figure 3:
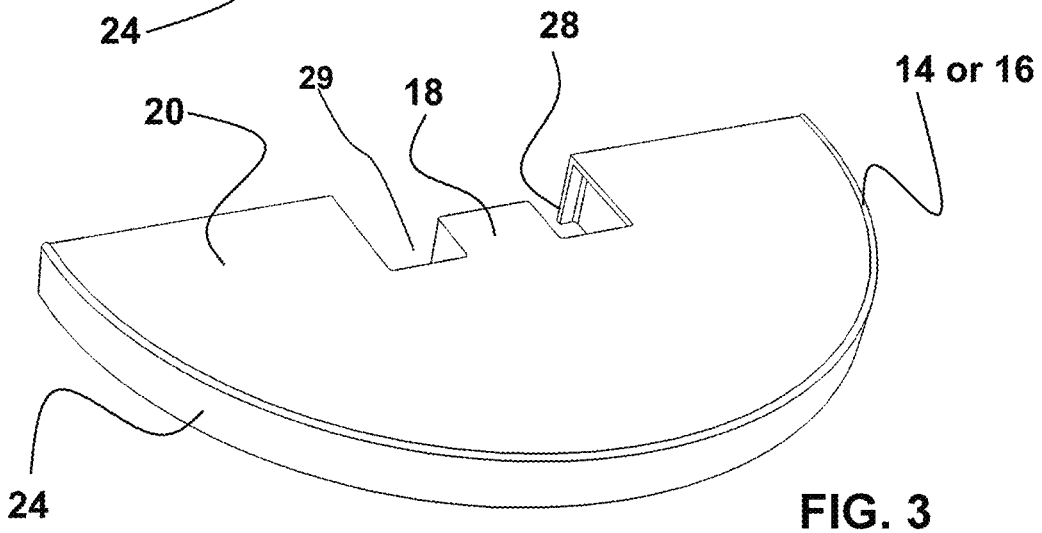
FIG. 3 depicts the device of FIG. 2 from another view.
Figure 4:
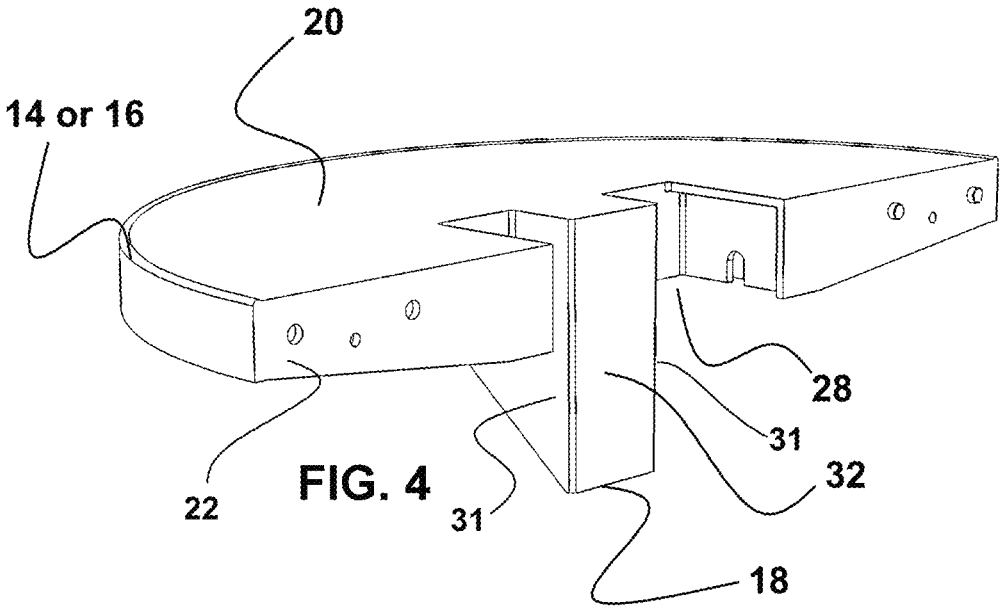
FIG. 4 depicts a mounting side edge of the table half section showing a planar surface having an H-shaped recess therein, which has a post contact surface positioned within the recess.

Shown in FIGS. 2-4 are differing views of a half section 14 or 16 of the table device 10. While the half sections are shown with a curved or linear exterior side edges 22, which will form a round or half round table when operatively engaged to a post 12, other shapes may be employed and are anticipated within the scope of this application.

Further shown in FIGS. 2-4, the half sections 14 or 16 have a planar top surface 20 and have a curved or half circular shaped side edge 24. Where two half sections are engaged to opposing sides of a post 12, the planar contact edges 22 of each will contact each other. Also, registration components are preferably positioned on each contact edge 22, such as projections 26 on one side of the centrally located recess 28 and complimentary cavities 30 located upon the other side of the recess 28. When two half sections 14 and 16 are joined on opposing sides of a post 12, the projections 26 will seat within the cavities 30 and hold both half sections in alignment. As noted, the half sections 14 or 16 may also be rectangular shaped wherein the side edge 24 would have a planar linear configuration with corners rather than the half circle curved shape shown.

Also shown in FIGS. 2-4 is the vertical support 18 formed in between the first recess 28 and second recess 29. This vertical support has a post contact surface 32 which will contact against a post 12 with a half section engaged thereto. Because the contact surface 32 extends from the top surface 20 for a distance below the bottom surface 38, it provides support for the half section 14 or 16 to prevent it from tipping or dismounting from the post 12 when items with weight are positioned upon the top surface 20.

Figure 5:
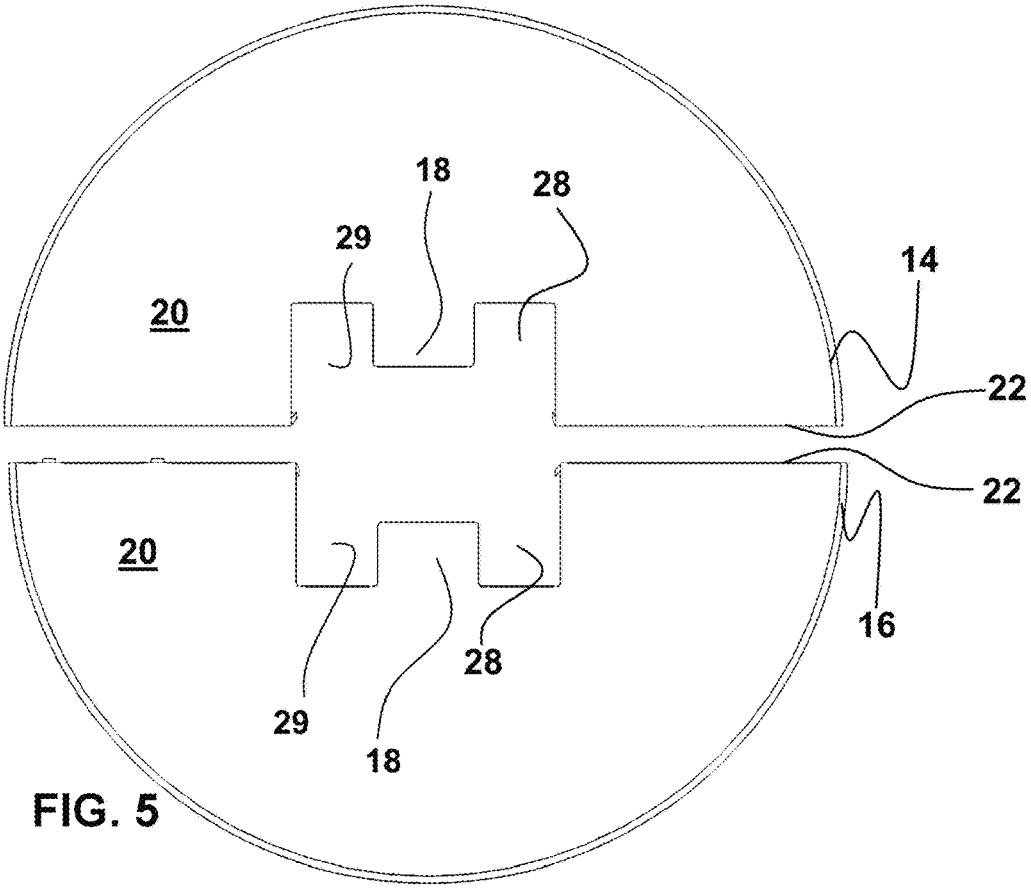
FIG. 5 shows an overhead view of the top surfaces of two half sections being joined upon a post such as shown in FIG. 1.
Figure 6:
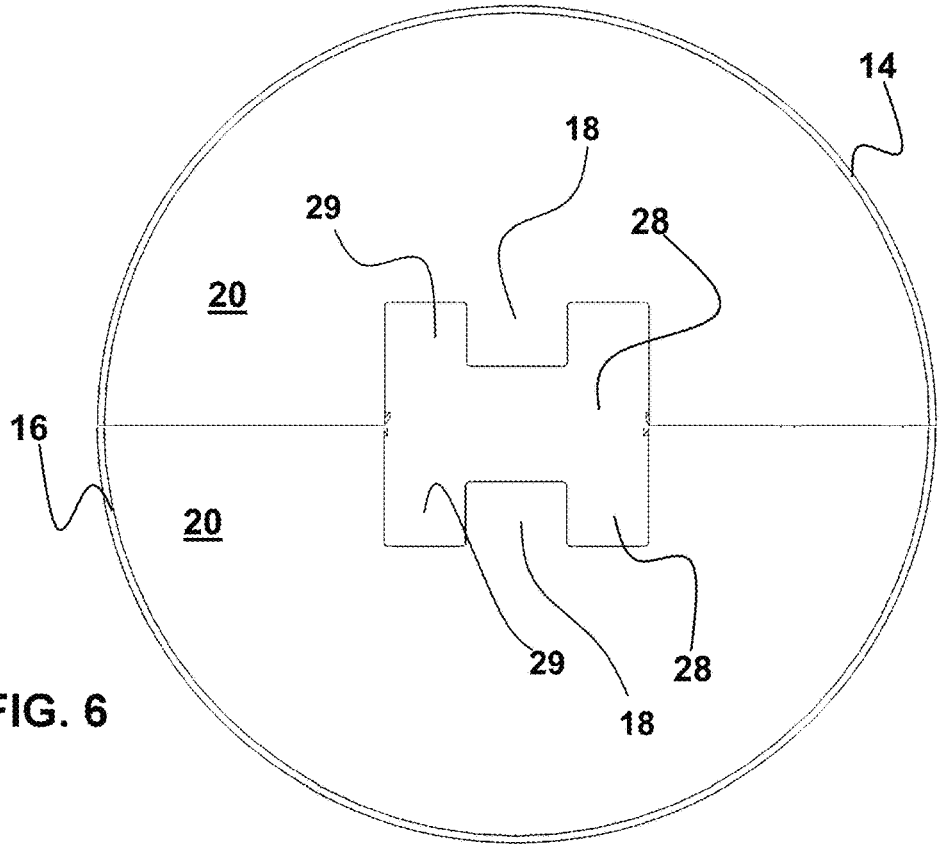
FIG. 6 shows the two half sections joined, wherein respective planar side surfaces are in contact and the formed H-shaped cavity is shaped to conform to the exterior surface of an H-shaped post such as in FIG. 1.

FIGS. 5-6 show the positioning of the first half section 14 and the second half section 16 on opposite sides of a post 12, such as in FIG. 1, to attach the half sections thereto. As shown, the recesses 28 and 29 are formed in mirror images of each other, such that when joined, as in FIG. 6, the formed recesses 28 and 29, with the vertical support 18 projecting therebetween, have a half H-shape which is complimentary to one side of an H-shaped post 12, such as in FIG. 1 or in FIG. 7. The forming of the recesses 28 and 29 on opposing sides of the vertical support 18 in a half H-shape is particularly preferred with the device 10 herein. This is because such allows for the operative positioning and use of opposing compressive fasteners 34 (FIG. 8) which are provided in engagements to each half section 14 or 16 using a threaded plate 40 which is engaged to a threaded member 41 and positioned in an engagement on the bottom surface 38 of each half section 14 and 16.

Figure 8:
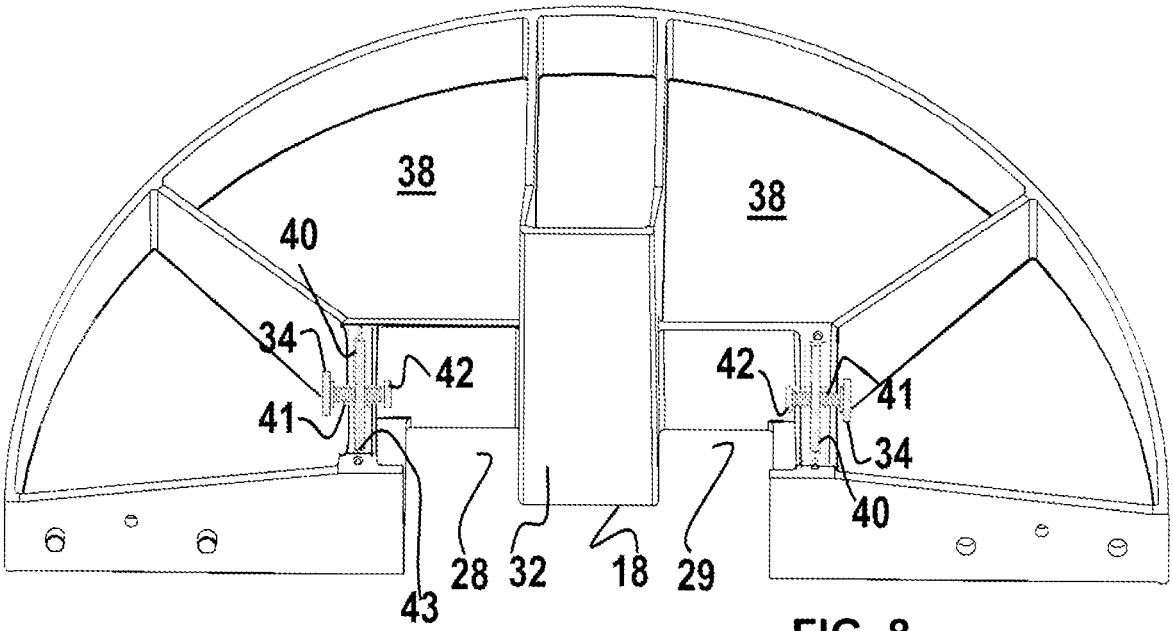
FIG. 8 shows the bottom view of a half section of the table device herein showing a first compressive fastener engaged with a first rib on one side of the recess and a second compressive fastener engaged with a second rib on an opposite side of the recess.

This construction, with ribs 36 projecting from the bottom 38 surface of each half section 14 and 16, is best shown in FIGS. 7-8. As can also be seen, the threaded plate 40 portion of the compressive fastener 34 is frictionally engaged within a slot 43 formed adjacent to each of the two recess 28 and 29 in each half section 14 and 16. Each of the compressive fasteners 34 will form a compressive contact against a surface of a post 12. For example, as shown, the compressive fastener 34 has a threaded member 41 which is operatively engaged through the threaded plate 40.

In use, each of the compressive fasteners 34 can thus be rotated in the threaded engagement with the threaded member 41 with a threaded opening in a respective threaded plate 40 and have contact portions 42 on one end of the compressive fastener 34 compressibly engage upon a surface of the post 12 located within one of the first or second recesses 28 and 29. Of course other compressive fasteners may be employed as would occur to those skilled in the art but the current preferred compressive contact is formed using the components herein as such allows the components to be held in engagement to the half sections and not lost. The compressive engagement, so formed, can be easily released and reformed. This allows one or each half section to be removably engaged and easily adjusted for differing height positions on the chosen post 12.

With the recesses 28 and 29 configured, as shown, for positioning around one side of an H-shaped post 12, the contact portions 42 of the compressive fasteners will each contact against an outside surface of each of the side sections 15 located on opposing sides of the slot or recess formed adjacent the cross section 13 of such an H-shaped post. While one compressive fastener 34 may provide a mount, two compressive fasteners 34 are preferred to provide an especially secure compressive engagement to the post 12. Such is easy to accomplish without tools by a simple rotation of the handle of the compressive fastener 34. For contact and removable mounting to a conventional rectangular post, such as in FIG. 9, only one of the compressive fasteners 34 need be engaged to a compressive engagement with the post 12.

It should be noted that the disclosed post engageable table device herein, has other applications potentially, and one skilled in the art could discover these, especially upon a reading of this specification. The explanation of the features of this invention does not limit the claims of this application and other applications developed by those skilled in the art are intended to be included in this invention.

It is additionally noted and anticipated that although the post engageable device herein is shown in its most simple form and shape, various components and aspects of the device may be differently shaped or slightly modified when forming the invention herein. As such, those skilled in the art will appreciate the descriptions and depictions set forth in this disclosure or merely meant to portray examples of preferred modes of the post engageable table device herein within the overall scope and intent of the invention, and are not to be considered limiting in any manner.

Further, while all of the fundamental characteristics and features of the invention have been shown and described herein, with reference to particular embodiments thereof, a latitude of modification, various changes and substitutions are intended in the foregoing disclosure as well as the claims which follow, and it will be apparent that in some instances, some features of the post engageable table invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A post engageable table apparatus, comprising:

a first table half section having a top surface opposite a bottom surface;

a side edge extending from said top surface;

a contact edge extending from said top surface and extending between opposing ends of said side edge;

said contact edge having a first recess;

said contact edge having a second recess;

a vertical support positioned between said first recess and said second recess;

said vertical support having a first side surface forming one side of said first recess and having a second side surface forming one side of said second recess;

a first compressive fastener engaged to said first table half section, said first table half section including a second compressive engagement with a second post section communicating through said second recess, by a compressive contact of said second post section in between said second side surface of said vertical support and one end of said second compressive fastener;

a second compressive fastener engaged to said first table half section; and said first table half section including a second compressive engagement with a second post section communicating through said second recess, by a compressive contact of said second post section in between said second side surface of said vertical support and one end of said second compressive fastener.

2. The post engageable table apparatus of claim 1, additionally including:

said vertical support having a post contact surface extending between said first side surface and said second side surface thereof; and said post contact surface for forming a support contact with a surface of said post.

3. The post engageable table apparatus of claim 1, additionally including:

a second table half section having a top surface opposite a bottom surface thereof;

a side edge of said second table having a section extending from said top surface thereof;

a contact edge of said second table half section extending from said top surface thereof and extending between opposing ends of said side edge thereof;

said contact edge of said second table half section having a first recess;

said contact edge of said second table half section having a second recess;

a vertical support of said second table half section positioned between said first recess and said second recess;

said vertical support of said second half section having a first side surface thereof forming one side of said first recess and having a second side surface forming one side of said second recess;

a third compressive fastener engaged to said second table half section; and said second table half section positionable to a third compressive engagement with an opposite side of said post where said first post section communicates through said first recess of said second half section, by a compressive contact of said first post section in between said first side surface of said vertical support of said second table half section and one end of said third compressive fastener engaged thereto; and said contact edge of said second table half section forming a contact against said contact edge of said first table half section with said second table half section in said third compressive engagement.

4. The post engageable table apparatus of claim 3, additionally including:

a fourth compressive fastener engaged to said second table half section; and said second table half section positionable to a fourth compressive engagement with a second post section communicating through said second recess of said second half section, by a compressive contact of said second post section in between said second side surface of said vertical support of said second table half section and one end of said fourth compressive fastener engaged thereto.

* * * * *